US008276684B2

(12) United States Patent
Chen

(10) Patent No.: US 8,276,684 B2
(45) Date of Patent: Oct. 2, 2012

(54) MACHINE TOOL WITH AUXILIARY CUSHION STRUCTURE

(75) Inventor: Bach Pangho Chen, Claremont, CA (US)

(73) Assignee: X'Pole Precision Tools Inc., Chung-Li, Taoyuan County (TW)

( * ) Notice: Subject to any disclaimer, the term of this patent is extended or adjusted under 35 U.S.C. 154(b) by 0 days.

(21) Appl. No.: 12/896,300

(22) Filed: Oct. 1, 2010

(65) Prior Publication Data

US 2012/0080205 A1 Apr. 5, 2012

(51) Int. Cl.
*B25F 5/02* (2006.01)

(52) U.S. Cl. ..... 173/171; 173/170; 173/162.1; 16/430; 74/522; 74/523

(58) Field of Classification Search ..... 173/170, 173/171, 162.1; 16/430; 74/522, 523
See application file for complete search history.

(56) References Cited

U.S. PATENT DOCUMENTS

| | | | | |
|---|---|---|---|---|
| 3,713,350 | A * | 1/1973 | Brilando | 74/551.9 |
| 4,875,386 | A * | 10/1989 | Dickerson | 74/551.9 |
| 6,128,808 | A * | 10/2000 | Jansson et al. | 16/431 |
| 6,131,862 | A * | 10/2000 | Gruenenfelder | 248/118 |
| 7,363,685 | B2 * | 4/2008 | Walker et al. | 16/430 |
| D610,428 | S * | 2/2010 | Lampka et al. | D8/70 |
| 2003/0143935 | A1 * | 7/2003 | Huber | 451/357 |
| 2004/0064868 | A1 * | 4/2004 | Williams et al. | 2/16 |
| 2005/0121562 | A1 * | 6/2005 | Baumgardner | 248/118.1 |
| 2008/0045127 | A1 * | 2/2008 | Lampka et al. | 451/357 |
| 2010/0180714 | A1 * | 7/2010 | Valentini | 74/522 |
| 2011/0230805 | A1 * | 9/2011 | Oron | 601/118 |

FOREIGN PATENT DOCUMENTS

TW M261316 4/2005

* cited by examiner

*Primary Examiner* — Lindsay Low
*Assistant Examiner* — Michelle Lopez
(74) *Attorney, Agent, or Firm* — Muncy, Geissler, Olds & Lowe, PLLC

(57) ABSTRACT

A machine tool with an auxiliary cushion structure includes a machine tool having a grip portion and a trigger switch mounted on the grip portion. The grip portion has a control lever pivotally mounted thereon to enable the control lever to rotate against the grip portion, so as to press the trigger switch during rotation and drive the machine tool to operate. The grip portion further has an auxiliary cushion mounted thereon and a gap is formed between the auxiliary cushion and the control lever. The auxiliary cushion has a supporting surface which is tilted upwards from one end close to the control lever to the other end. Thus no matter the control lever is pressed by the operator or released, the operator's hand can rest on the supporting surface to alleviate or ease the fatigue.

7 Claims, 6 Drawing Sheets

MACHINE TOOL WITH AUXILIARY CUSHION STRUCTURE

FIELD OF THE INVENTION

The present invention is related to a machine tool with an auxiliary cushion structure, and more particularly to an auxiliary cushion structure adapted to a machine tool to support the hand of the operator.

BACKGROUND OF THE INVENTION

Because the machine tool is characteristic of small volume, low price and capable of being connected to various kinds of application tools, such as grinding discs, emery wheel machines, drilling machines and electric wrenches, it is popular for the operator to rapidly perform the work. In addition to the electric tool driven by electricity, the machine tool also includes the pneumatic tool driven by air pressure.

Currently, the common used machine tool, such as the grinding machine, is disclosed in R.O.C. Patent No. M261316. The machine tool mentioned above mainly includes a main body, a grip portion extended from the main body, a trigger button mounted on the grip portion, a control lever contacting with the trigger button and pivotally mounted thereon, a motor held inside the main body, and a tool shaft connected to the motor. Therefore, when the operator presses the control lever to push the trigger button, the motor and the tool shaft can be driven to operate, and thus drive an action element connected with the tool shaft to rotate and to process a workpiece.

However, as operating the machine tool described above, mostly the operator presses one end of the control lever by the front part of the palm and hold the main body of the machine tool by the fingers, so that the rear part of the palm is suspended, thereby fatiguing the operator's hand easily after a long period of time, and even the muscles or joints become ill and feel pain.

For solving this problem, a machine tool which can support the hand of the operator has been developed, as disclosed in US publication No. 2010/0180714. In this prior art, the disclosed machine tool is similar to the traditional one in which a control lever is pivotally mounted thereon, especially the control lever forms a fore end part and a rear end part at two ends of the pivot location. When in use, the fore end part of the control lever is pressed by the front part of the palm of the operator with the rear end part of the control lever is butted by the rear part of the palm of the operator, so as to support the hand during operation.

However, the operation described above is similar to a seesaw, as shown in FIG. 1 and FIG. 2. When the rear part of the palm butts the rear end part 103 of the control lever 101, the fore end part 102 of the control lever 101 is lifted due to lever principle, so that the machine tool 100 cannot operate normally (as shown in FIG. 1). When the front part of the palm presses the fore end part 102 of the control lever 101, the rear end part 103 of the control lever 101 also is lifted due to lever principle, so that the hand of the operator is propped up by the rear end part 103, thereby losing the support (as shown in FIG. 2). Therefore, this prior art still cannot provide proper support for the hand of the operator while the control lever 101 being pressed to operate the machine tool 100.

SUMMARY OF THE INVENTION

The object of the present invention is to solve the problem described above, so as to provide stable support for the hand of the operator no matter the machine tool is in an operating condition or non-operating condition.

For achieving the object described above, the present invention provides a machine tool with an auxiliary cushion structure including a machine tool and an auxiliary cushion mounted on the machine tool. The machine tool has a grip portion and a trigger switch mounted on the grip portion. The grip portion has a control lever pivotally mounted thereon to enable the control lever to rotate, so as to press the trigger switch during the rotation. The auxiliary cushion is mounted on the grip portion and a gap is formed between the auxiliary cushion and the control lever. Then, the auxiliary cushion has a supporting surface which is tilted upwards from one end close to the control lever to the other end.

Accordingly, owing to the gap between the auxiliary cushion and the control lever, the auxiliary cushion and the control lever will not being moved together or interfere with each other, so that when the control lever is pressed or released, the auxiliary cushion can remain constant tilted angle to provide stable support.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
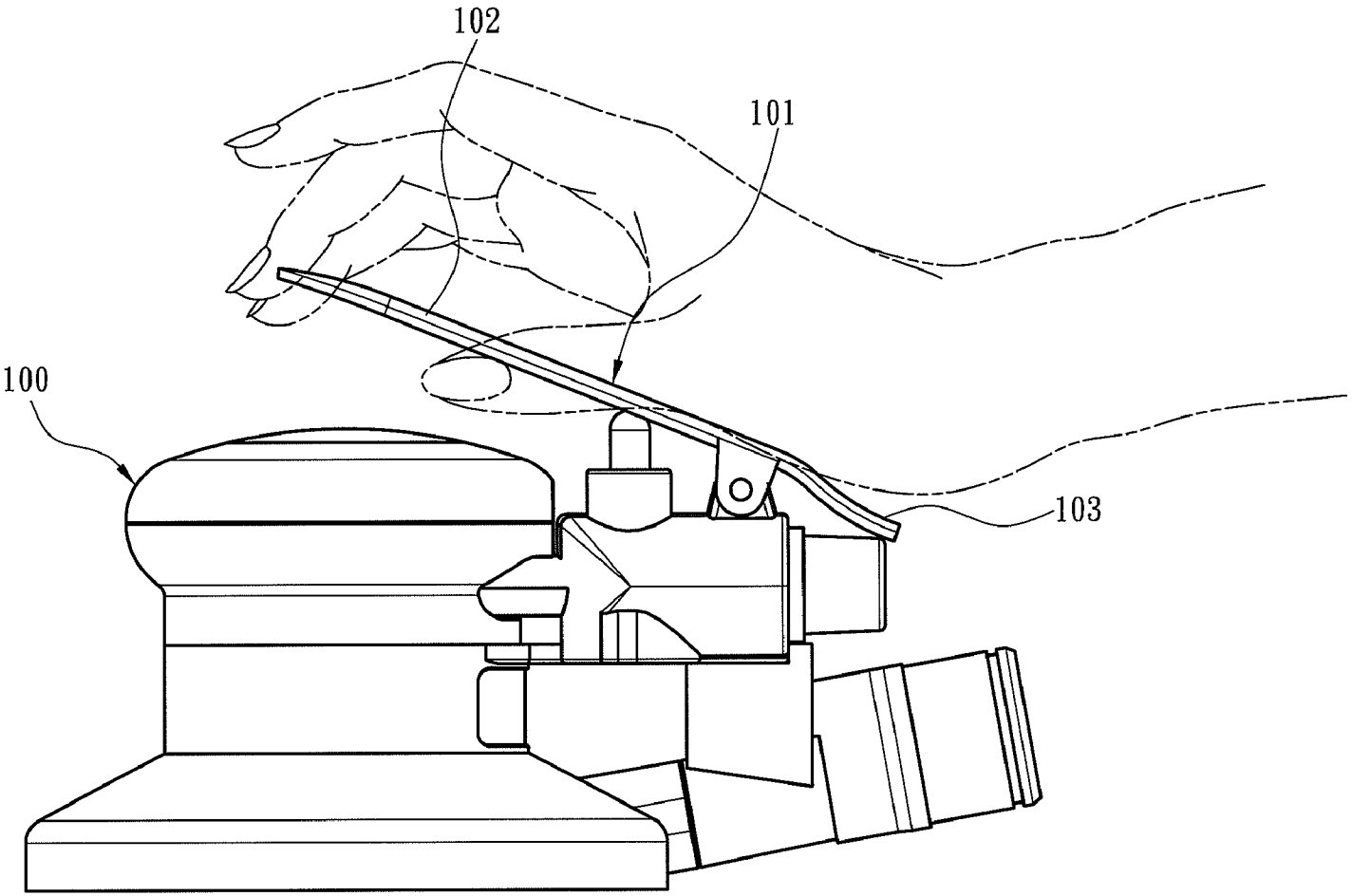
Fig. 1 PRIOR ART
FIG. 1 is a schematic view of a conventional machine tool in a use condition.
Figure 2:
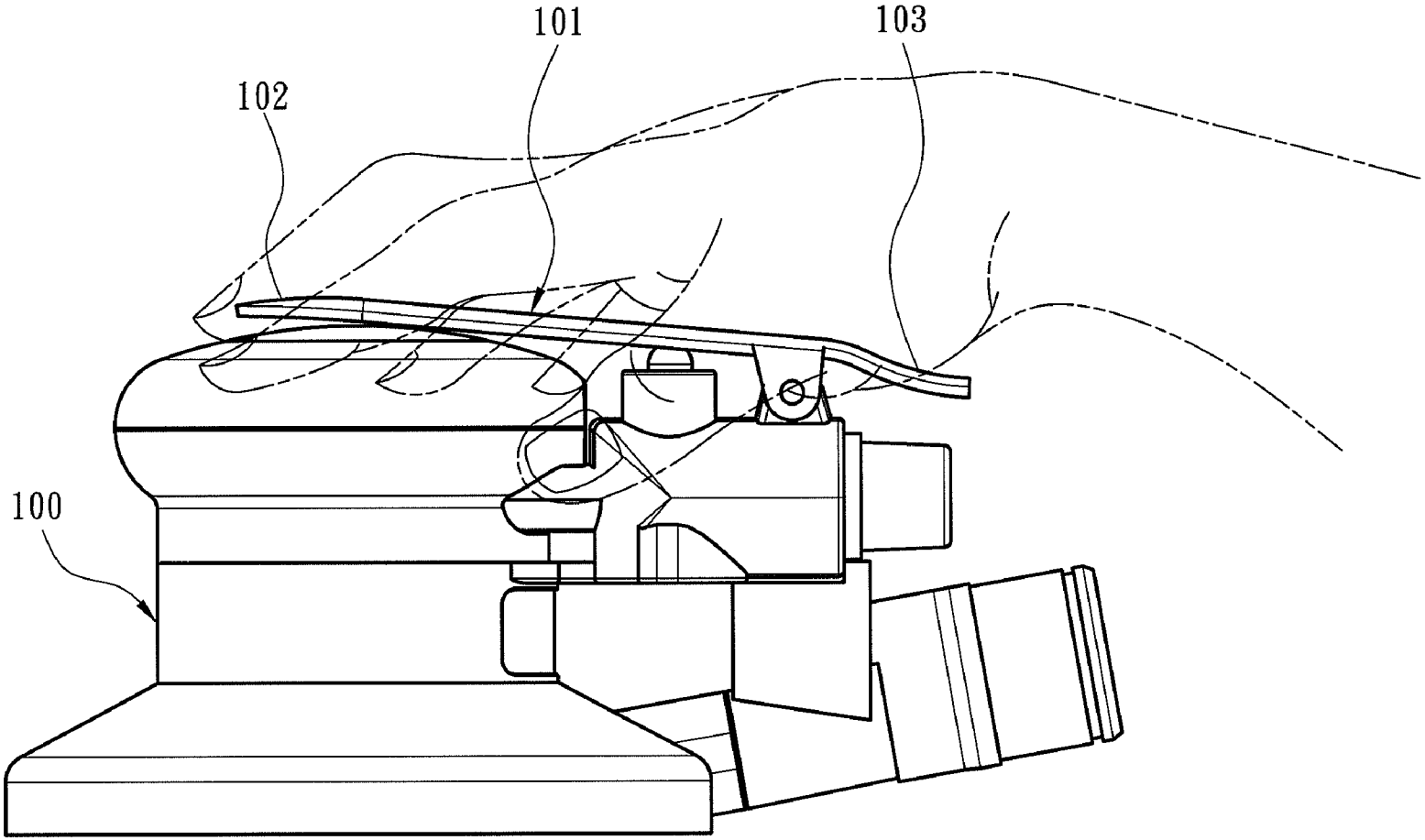
Fig. 2 PRIOR ART
FIG. 2 is another schematic view of a conventional machine tool in a use condition.
Figure 3:
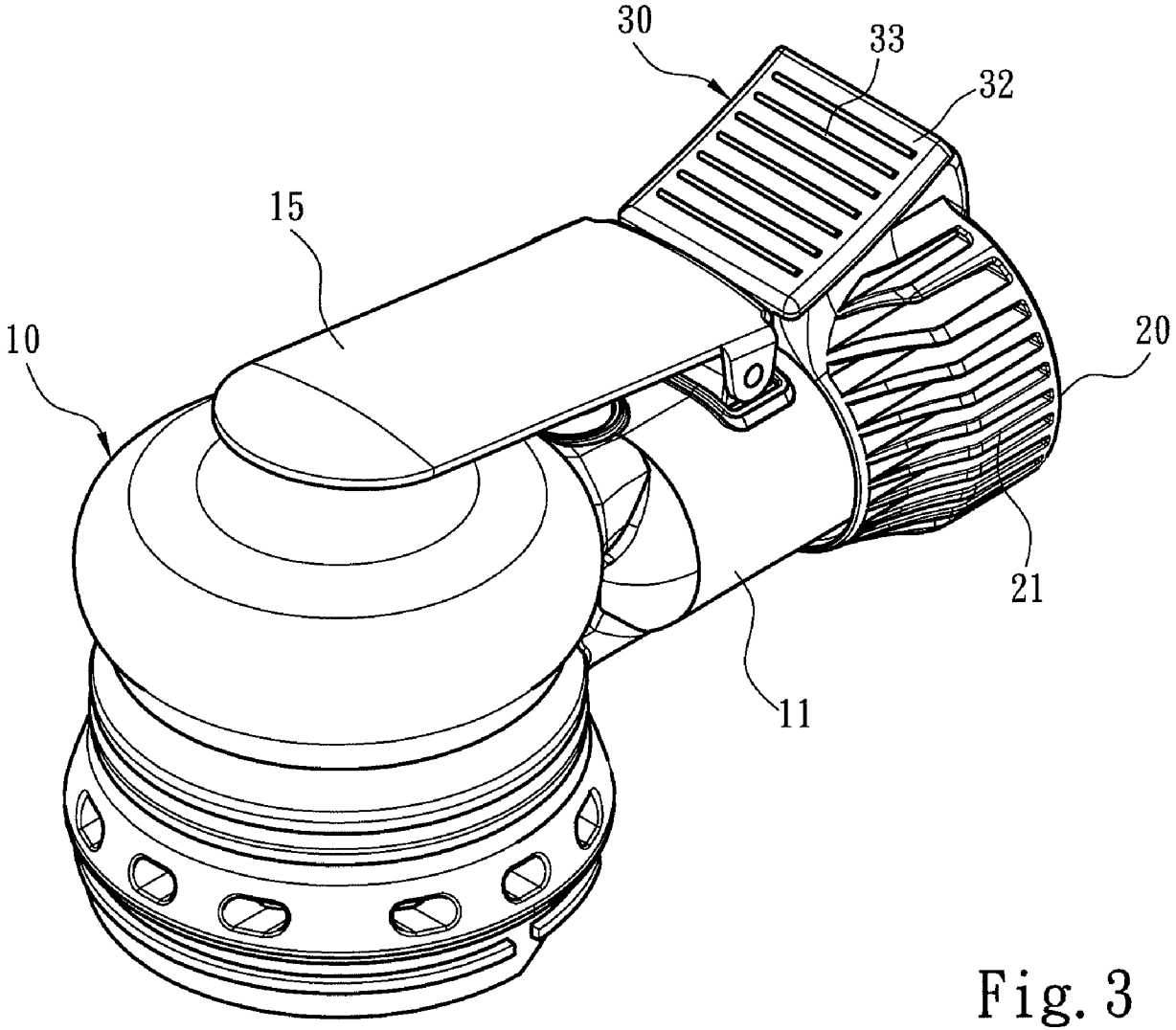
FIG. 3 is a perspective view of the present invention.
Figure 4:
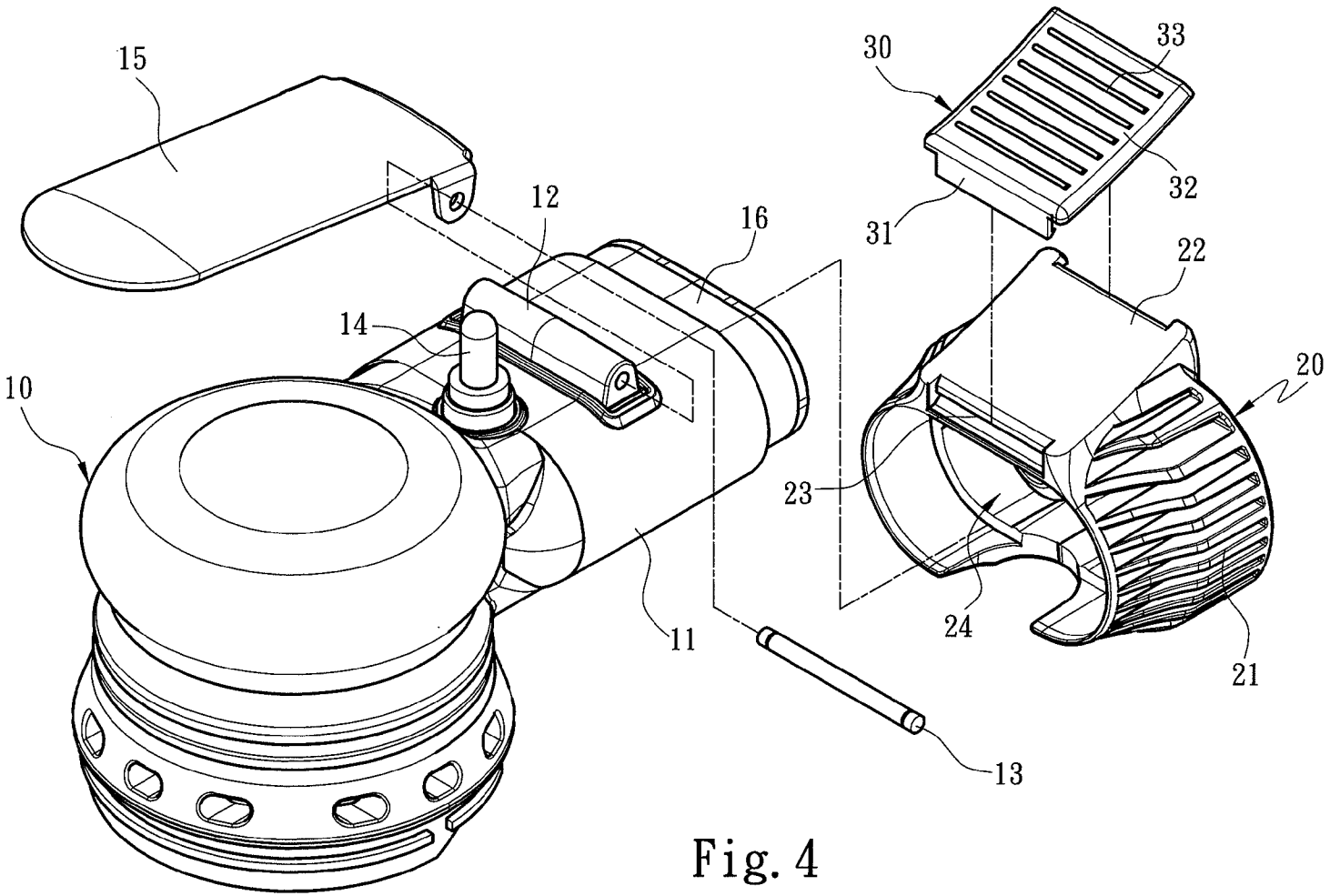
FIG. 4 is an exploded view of the present invention.

Please refer to FIG. 3 and FIG. 4. The present invention is related to a machine tool with an auxiliary cushion structure including a machine tool 10 and an auxiliary cushion 30 mounted on the machine tool 10. The machine tool 10 can be a grinding machine. The machine tool 10 has a grip portion 11 extended from the main body thereof for being held by the operator. The grip portion 11 has a trigger switch 14, a hinge portion 12 mounted thereon, and a connecting portion 16 which is at the rear of the grip portion 11, wherein a pivot 13 is penetrated through a control lever 15 and the hinge portion 12, so that the control lever 15 is pivotally mounted on the grip portion 11 and can be rotated about the pivot 13. Therefore, during the rotation, the control lever 15 presses the trigger switch 14 to drive the motor (not shown in the drawings) held in the machine tool 10 to operate.

Figure 5:
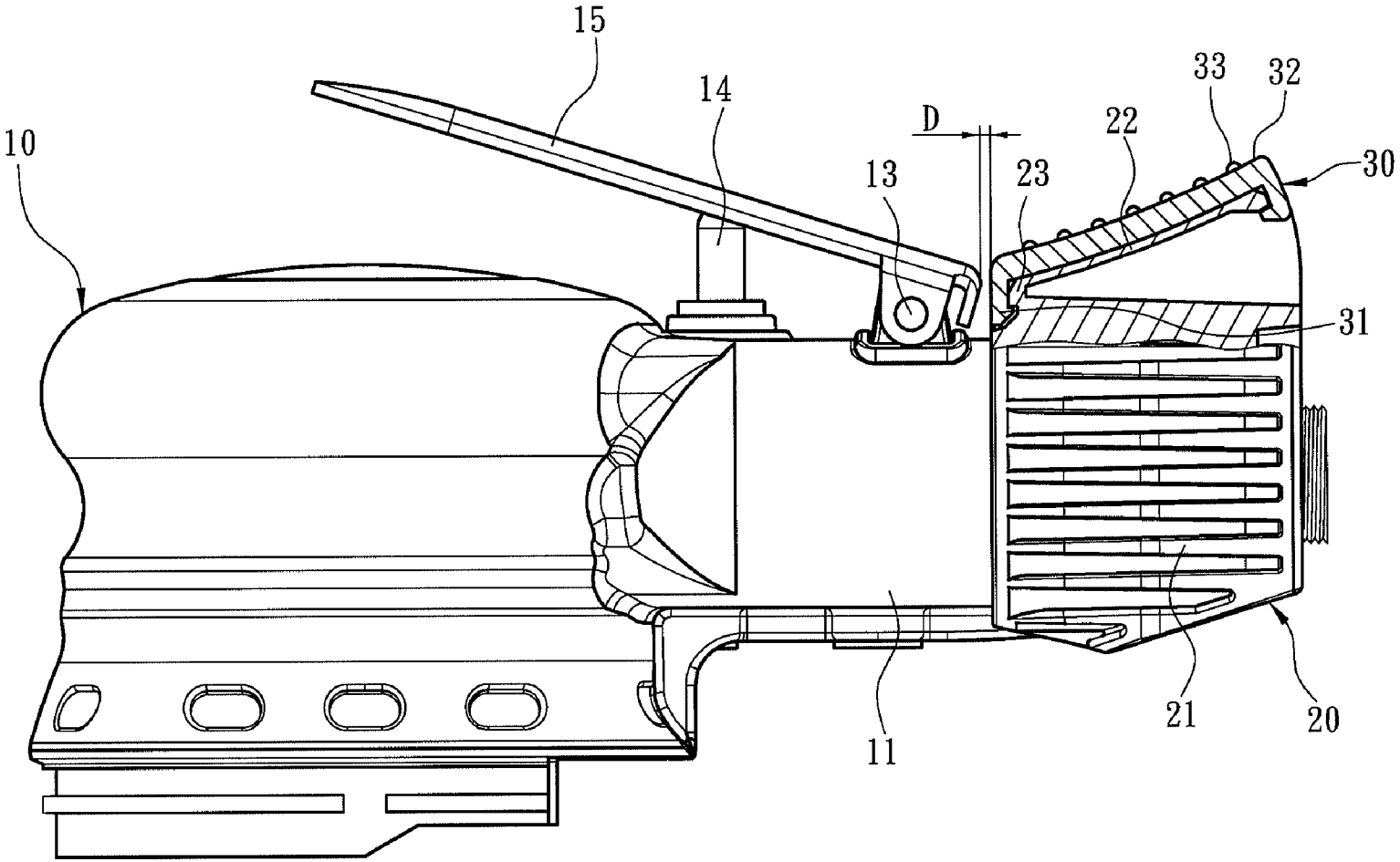
FIG. 5 is a partial sectional view of the present invention.
Figure 6:
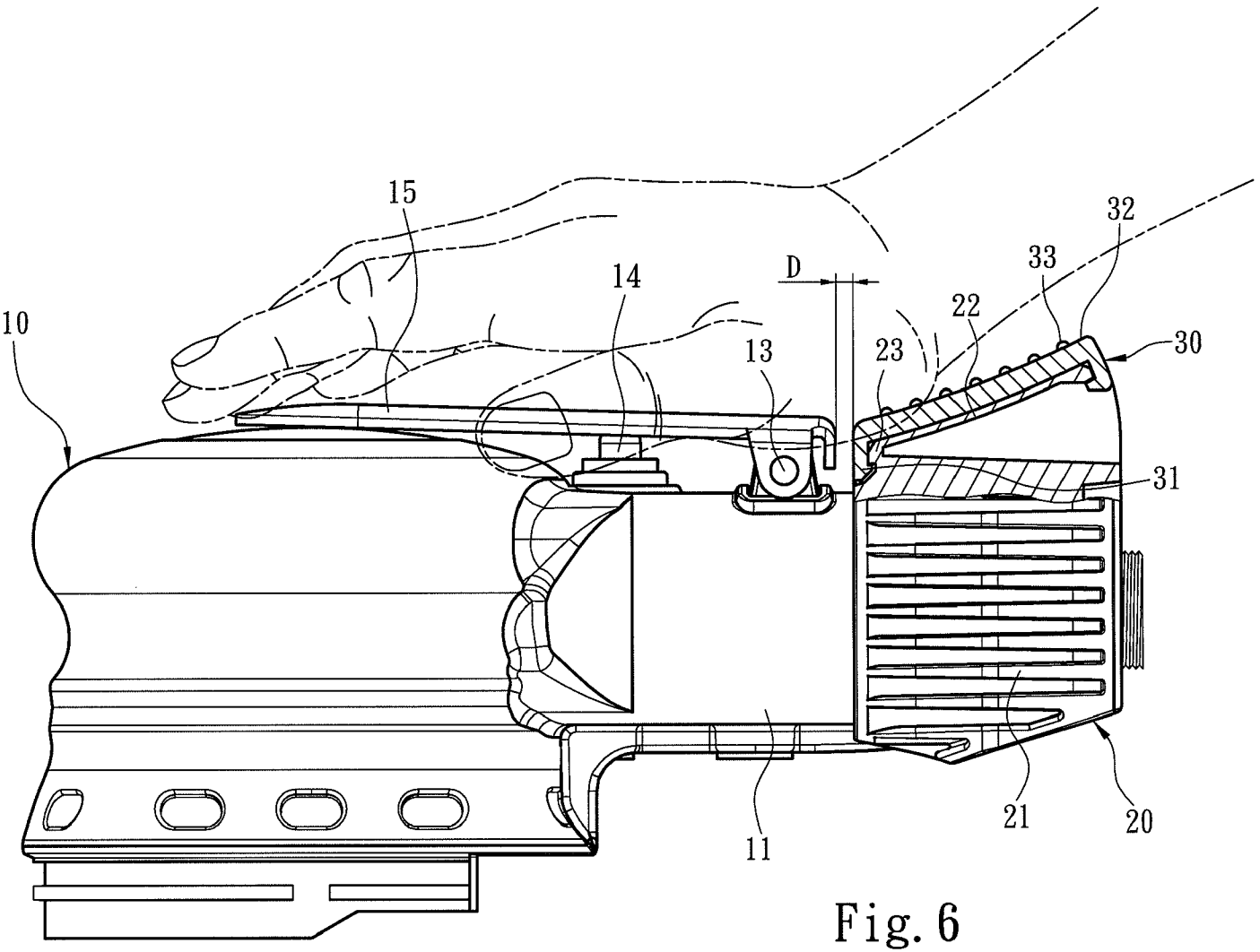
FIG. 6 is a schematic view of the present invention in a use condition.

Further, please refer to FIG. 4 and FIG. 5. The machine tool 10 further includes a heat dissipation seat 20 mounted on the grip portion 11. The heat dissipation seat 20 is made of heat conduction material and has a plurality of radiation fins 21 for dissipating heat from the grip portion 11 outwardly. Moreover, the heat dissipation seat 20 includes a bearing portion 22 for mounting the auxiliary cushion 30 and an opening 24 which can be run through by the connecting portion 16, wherein the bearing portion 22 and the auxiliary cushion 30 respectively have a first anchor portion 23 and a second anchor portion 31 connected with other, and wherein the bearing portion 22 connects to the radiation fins 21. As shown in the drawings, the first anchor portion 23 and the second anchor portion 31 can be a pair of latch hooks latched with each other. In the present invention, the auxiliary cushion 30 is not limited to be mounted on the heat dissipation seat 20, the auxiliary cushion 30 also can be directly mounted on the grip portion 11. Furthermore, the auxiliary cushion 30 and the control lever 15 are arranged separately to form a gap d therebetween. The auxiliary cushion 30 has a supporting surface 32 which is tilted upwards from one end close to the control lever 15 to the other end, so that the operator can rest the hand on the supporting surface 32 during operation. Here, the supporting surface 32 can be formed to be a concave arc surface which is designed by ergonomics to match the profile of the hand, or an inclined surface without curvature. In addition, the supporting surface 32 further has non-slip textures 33 formed thereon to prevent the hand from coming off the supporting surface 32 owing to vibration during operation, so as to enhance supporting stability. Moreover, the auxiliary cushion 30 can be made of flexible material, such as rubber, to absorb the vibration of the machine tool 10 during operation and thus provide appropriate buffer for the hand. Then, please refer to FIG. 6. Through the gap d between the auxiliary cushion 30 and the control lever 15, when the operator presses the control lever 15, the auxiliary cushion 30 and the control lever 15 will not interfere with each other, and the hand of the operator can be continuously supported.

In conclusion, the present invention provides an auxiliary cushion 30 additionally on the grip portion 11 of the control lever 15 which is pivotally mounted on the machine tool 10. The auxiliary cushion 30 has the supporting surface 32 to support the operator's hand. Particularly, the auxiliary cushion 30 and the control lever 15 are separately formed by a gap d and the supporting surface 32 is tilted upwards from one end close to the control lever 15 to the other end. Thus during the operation, no matter the control lever 15 is pressed or not, the auxiliary cushion 30 can remain the constant tilted angle and the hand can stably rest on the supporting surface 32, so as to alleviate or ease the fatigue of the hand.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A machine tool with an auxiliary cushion structure, comprising:

a machine tool including a grip portion and a trigger switch mounted on the grip portion, the grip portion including a connecting portion and a control lever pivotally mounted thereon to enable the control lever to rotate and to press the trigger switch during rotation of the control lever;

a heat dissipation seat which includes a bearing portion, a plurality of radiation fins which connect to the bearing portion and an opening which can be run through by the connecting portion; and an auxiliary cushion mounted on the bearing portion of the heat dissipation seat and spaced from the control lever by a gap formed therebetween, the auxiliary cushion including a supporting surface which is tilted upwards from one end close to the control lever to the other end.

2. The machine tool with the auxiliary cushion structure as claimed in claim 1, wherein the bearing portion and the auxiliary cushion respectively have a first anchor portion and a second anchor portion connected with each other.

3. The machine tool with the auxiliary cushion structure as claimed in claim 2, wherein the first anchor portion and the second anchor portion are a pair of latch hooks latched with each other.

4. The machine tool with the auxiliary cushion structure as claimed in claim 1, wherein the supporting surface includes non-slip textures mounted thereon.

5. The machine tool with the auxiliary cushion structure as claimed in claim 1, wherein the supporting surface is an arc surface.

6. The machine tool with the auxiliary cushion structure as claimed in claim 1, wherein the supporting surface is an inclined surface.

7. The machine tool with the auxiliary cushion structure as claimed in claim 1, wherein the auxiliary cushion is made of flexible material.

* * * * *